US011230674B2

(12) United States Patent
Lan et al.

(10) Patent No.: US 11,230,674 B2
(45) Date of Patent: Jan. 25, 2022

(54) INTEGRATED METHOD AND APPARATUS FOR CATALYTIC CRACKING OF HEAVY OIL AND PRODUCTION OF SYNGAS

(71) Applicant: CHINA UNIVERSITY OF PETROLEUM-BEIJING, Beijing (CN)

(72) Inventors: Xingying Lan, Beijing (CN); Yuming Zhang, Beijing (CN); Jinsen Gao, Beijing (CN); Chengxiu Wang, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 0 days.

(21) Appl. No.: 17/028,930

(22) Filed: Sep. 22, 2020

(65) Prior Publication Data

US 2021/0087479 A1 Mar. 25, 2021

(30) Foreign Application Priority Data

Sep. 23, 2019 (CN) ..... 201910900588.9

(51) Int. Cl.
*C10G 55/06* (2006.01)
*C10J 3/56* (2006.01)

(52) U.S. Cl.
CPC ..... *C10G 55/06* (2013.01); *C10J 3/56* (2013.01); *C10G 2300/107* (2013.01);
(Continued)

(58) Field of Classification Search
CPC ..... C10J 3/56; C10J 3/54; C10J 3/84; C10J 2300/1807; C10J 2300/0903;
(Continued)

(56) References Cited

U.S. PATENT DOCUMENTS 2,881,130 A 4/1959 Pfeiffer
3,072,516 A 1/1963 Bellinger
(Continued)

FOREIGN PATENT DOCUMENTS

CN 101451073 A 6/2009
CN 101657526 2/2010
(Continued)

*Primary Examiner* — Randy Boyer
*Assistant Examiner* — Juan C Valencia
(74) *Attorney, Agent, or Firm* — J.C. Patents

(57) ABSTRACT

The present disclosure provides an integrated method and apparatus for catalytic cracking of heavy oil and production of syngas. A cracking-gasification coupled reactor having a cracking section and a gasification section is used as a reactor in the method. A heavy oil feedstock is fed into a cracking section to contact with a bed material in a fluidized state that contains a cracking catalyst, a catalytic cracking reaction is conducted under atmospheric pressure to obtain light oil-gas and coke. The coke is carried downward by the bed material into a gasification section to conduct a gasification reaction to generate syngas; the syngas goes upward into the cracking section to merge with the light oil-gas, and is guided out from the coupled reactor and enter a gas-solid separation system. Oil-gas fractionation is performed to a purified oil-gas product output from the gas-solid separation system to collect light oil and syngas products.

17 Claims, 3 Drawing Sheets

(52) U.S. Cl.
CPC . *C10G 2300/1077* (2013.01); *C10G 2300/30* (2013.01); *C10G 2300/4025* (2013.01); *C10G 2300/4081* (2013.01); *C10G 2300/70* (2013.01); *C10G 2400/06* (2013.01); *C10J 2300/0943* (2013.01); *C10J 2300/1615* (2013.01); *C10J 2300/1807* (2013.01)

(58) Field of Classification Search
CPC ..... C10J 2300/0959; C10J 2300/0976; C10J 2300/0956; C10J 2300/0906; C10J 2300/0943; C10G 1/002; C10G 1/045; C10G 9/32; C10G 2300/1074; C10G 2300/1059; B01D 3/143; C10B 55/10
See application file for complete search history.

(56) References Cited

U.S. PATENT DOCUMENTS 4,213,848 A * 7/1980 Saxton ..... C10B 49/10 208/127
4,325,815 A * 4/1982 Metrailer ..... C10B 55/10 208/127
4,511,459 A * 4/1985 Yan ..... C10G 9/32 201/17

FOREIGN PATENT DOCUMENTS

CN 102115675 A 7/2011
CN 102234522 A 11/2011
CN 102234534 A 11/2011
CN 107099328 A 8/2017
CN 108587674 A 9/2018

* cited by examiner

INTEGRATED METHOD AND APPARATUS FOR CATALYTIC CRACKING OF HEAVY OIL AND PRODUCTION OF SYNGAS

CROSS-REFERENCE TO RELATED APPLICATIONS

This application claims the priority benefit of China Patent Application No. 201910900588.9 filed on Sep. 23, 2019, the content of which is hereby incorporated by reference in its entirety.

TECHNICAL FIELD

The present disclosure relates to an integrated method and apparatus for catalytic cracking of heavy oil and production of syngas and, in particular, to an integrated method and apparatus for catalytic cracking of heavy oil and coke gasification thereof for the production of syngas, which belongs to the field of petroleum processing technologies.

BACKGROUND

Heavy oil is a residue remained after that crude oil is fractionated to extract gasoline, kerosene, diesel and the like; moreover, there also are abundant resources of heavy oil in stratum. The heavy oil generally has characteristics of heavy component, low H/C (hydrogen-to-carbon) ratio, high contents of sulfur/nitrogen element and heavy metals, large carbon residue value and the like. With crude oil becoming heavier in component and inferior in quality, there is a sharp increase in output of inferior heavy oil and residual oil (such as thickened oil, highly thickened oil, oil sand asphalt, atmospheric residual oil, FCC slurry, deoiled asphalt and the like). How to process heavy oil and convert it into qualified and clean oil products, such as gasoline, diesel, liquefied gas and the like, is a main challenge faced by petroleum processing enterprises at present.

Heavy oil generally has high contents of collide and asphaltene, resulting in a severe tendency for the heavy oil to coke during processing. Processing routes of the heavy oil may be roughly classified into two types: hydrogenation and decarbonization. Currently, the heavy oil is processed directly by means of catalytic cracking, catalytic hydrogenation or the like. However, as limited by problems existing in the processing, such as inactivation of catalyst, high hydrogen consumption, long operating period and the like, it is difficult to satisfy the requirements for directly processing of large amount of inferior heavy oil by general means, such as catalytic cracking, catalytic hydrogenation or the like. Delayed coking process has become a widely used processing technology for inferior heavy oil and residual oil at present, due to relatively low investment, proven technology and adaptability to inferior feedstocks. However, a large amount of solid petroleum coke would be generated as a by-product of the delayed coking process, and in particular, a large amount of high-sulfur coke with relatively low value would be generated when processing high-sulfur inferior feedstock. In addition, according to the latest environmental protection requirements, measures have been taken to restrict high-sulfur coke with a sulfur content higher than 3% to be exported from the factory, which imposes new requirements on the delayed coking process and limits application of the delayed coking process to certain extent.

Furthermore, due to a relatively low H/C atomic ratio of inferior heavy oil feedstocks, a hydrogenation process is necessary to meet the production quality requirement of clean oil products. A shortage of hydrogen sources of refineries is more prominent in the processing of inferior heavy oil, and the hydrogen generated by catalytic reforming and other processes is insufficient to meet the requirement of clean oil production. Heavy oil may be converted directly into small molecules such as syngas and the like by a direct gasification of inferior heavy oil. However, oil-gas molecules and hydrogen element that stored in the heavy oil are not fully utilized in the gasification of heavy oil, which causes the waste of resources of the heavy oil to certain extent.

Heavy oil is first cracked to obtain a lightened oil product, and a heavy coke is gasified or partially combusted to obtain syngas or fuel gas for subsequent hydrogen production, and thus realizing a graded conversion and utilization of heavy oil based on an integrated process of heavy oil cracking and coke gasification, which can avoid the generation of a large amount of coke and obtain light oil and syngas/fuel gas at the same time, and has a good technological advancement.

U.S. Pat. No. 2,881,130 discloses a fluidized coking technology, according to which inferior heavy oil is preheated and mixed with water vapor, and then enter a bed reactor via a nozzle, where it is thermally cracked in contact with high-temperature coke powder in a fluidized state in a range of 450 to 600° C. On the one hand, the heavy oil undergoes an upgrading reaction on the surface of the coke powder to produce oil-gas and enters a subsequent oil-gas recycle fractionation system, and on the other hand, heavy components are condensed on the surface of the coke powder to produce coke, the coke is partially combusted for regeneration in a subsequent coke heater, and the regenerated high-temperature coke powder is returned to a cracker to provide heat required for preheating the heavy oil and the cracking reaction. Compared to the delayed coking technology, the process improves a processing range of inferior heavy oil to certain extent, and has advantageous of continuous operations, high yield of liquid and the like.

U.S. Pat. No. 3,072,516 discloses a flexible coking technology to address the challenge of utilizing a large amount of pulverized coke produced by a fluidized coking process. The flexible coking process adds a gasifier to fluidized coking, where most of the coke reacts with air and water vapor in the gasifier to generate a flexible gas. However, since a relatively large amount of air is introduced in a process of coke gasification, the flexible gas has a low calorific value, and thus, cannot be served as a high-quality syngas to supplement the refinery's a hydrogen source. In addition, the fluidized coking and flexible coking processes use coke powder as the heat carrier for the heavy oil cracking reaction, which requires control of the particle size and shape of the coke powder, involves fluidization cycles among multiple reactors, and is complicated by the need to prevent coke powder agglomeration.

CN101657526B discloses an improved fluidized coking process, proposing to introduce an effective amount of alkaline materials into a heavy oil fluidized coking reaction area to overcome relative problems, such as a formation of sticky substances, in the fluidized coking process. In order to improve the fluidization properties of the reaction bed material, prevent the agglomeration of coked particles, and meanwhile obtain a better distribution of cracking products, the selection of a low activity catalytic carrier as a fluidized coking medium for heavy oil cracking has become the choice of many patented technologies.

CN102234534A discloses a method for processing inferior heavy oil. In the method, a heavy oil cracking reaction is carried out firstly, where a low-activity contact agent is selected, and after the reaction, a carbon deposition contact agent is sent to different reaction areas of a gasifier for combustion or gasification regeneration, a semi-regeneration agent and a second-stage regeneration agent with different coke contents are obtained, respectively. A multi-stage regeneration reaction in the reactor increases difficulties in operations of the process to certain extent.

CN102115675A discloses a method and an apparatus for heavy oil upgrading processing. Feedstock oil firstly reacts with a solid heat carrier in a thermal cracking reactor to obtain a light oil-gas product. The solid heat carrier with heavy coke attached to its surface enters a combustion (gasification) reactor through a refeed valve to remove the coke on the surface. After regeneration, the solid heat carriers are with a high-temperature partially returned to the thermal cracking reactor through a distribution valve and serve as reaction bed material.

In the above methods, different types of reactors such as a fluidized bed, a lifting tube, a downdraft bed and the like are adopted in the heavy oil cracking reaction, however, the generated heavy coke needs to be transported to another reactor for regeneration reactions such as gasification, combustion and the like, so that materials have to be recycled among multiple reactors, resulting in a large footprint of a device and a high energy consumption in a practical production.

SUMMARY

Directing at the abovementioned drawbacks, the present disclosure provides an integrated method for catalytic cracking of heavy oil and production of syngas, which realizes mutual supply of materials and complementary of energy between two reaction processes of heavy oil cracking and coke gasification, reduces energy consumption during the heavy oil processing, and improves yield and quality of light oil-gas product, and meanwhile, reduces difficulties of process operation.

The present disclosure further provides an integrated apparatus for catalytic cracking of heavy oil and production of syngas to implement the abovementioned integrated method. Energy consumption can be reduced and a footprint of the device can be saved by using the apparatus in the heavy oil processing.

The present disclosure provides an integrated method for catalytic cracking of heavy oil and production of syngas, a cracking-gasification coupled reactor having a cracking section and a gasification section that are internally connected with each other is used as a reactor, the integrated method includes:

feeding a heavy oil feedstock into the cracking section in an upper portion of the cracking-gasification coupled reactor to contact with a bed material in a fluidized state that contains a cracking catalyst, a catalytic cracking reaction is conducted under atmospheric pressure to obtain light oil-gas and coke; the coke is carried downward by the bed material into the gasification section in a lower portion of the cracking-gasification coupled reactor to conduct a gasification reaction to generate syngas; the syngas goes upward in the cracking-gasification coupled reactor into the cracking section to merge with the light oil-gas, and is guided out from the coupled reactor to a gas-solid separation system;

subjecting the light oil-gas and the syngas in the gas-solid separation system to at least a first-stage gas-solid separation, and bed material particles separated out are collected and divided into two parts, and returned to the cracking section and the gasification section, respectively, to form a first-stage circulation and a second-stage circulation of the bed material particles accordingly; and performing oil-gas fractionation to a purified oil-gas product output from the gas-solid separation system to collect light oil and syngas products.

According to the integrated method of the present disclosure, a cracking-gasification coupled reactor having the cracking section in the upper portion and the gasification section in the lower portion connected with each other is adopted, where a catalytic cracking reaction of the heavy oil takes place in the cracking section, and the coke generated attaches to the surface of the bed material and is carried downward by the bed material into the gasification section to be used as a reactive material of the gasification section for the gasification reaction, to generate syngas; the syngas goes upward and enters the cracking section, which not only provides heat for the cracking section, but also serves as reaction atmosphere for the heavy oil catalyst cracking, enriching hydrogen sources, realizing mutual supply of material and complementary of energy in two reaction processes of heavy oil catalyst cracking and coke gasification, simplifying the processing and reduces energy consumption. On this basis, addition of the cracking catalyst further improves processing capability of entire system, and improves the yield and the quality of obtained oil-gas product. Besides, the syngas may be obtained by oil-gas fractionation during the heavy oil upgrading processing to supplement hydrogen sources of a refinery.

Generally, in the present disclosure, an atomization processing may be performed to the heavy oil feedstock when it enters the cracking section to increase a contact area of the heavy oil feedstock and the fluidized bed material and further improve reaction efficient of cracking reaction. For example, in an embodiment, an atomization apparatus may be provided at a feedstock inlet, through which the heavy oil feedstock enters the cracking section, to perform an atomization processing to the heavy oil feedstock. In that case, the feedstock inlet and the atomization apparatus may be provided in an upper portion of the cracking section to facilitate evenly mixing of atomized heavy oil drops and the fluidized bed material.

In the present disclosure, the heavy oil feedstock contacts with the fluidized bed material in the cracking section and undergoes a catalytic cracking reaction to generate light oil-gas and coke, and the coke attaches to the surface of the bed material, which causes the bed material to form solid particles with different particle sizes (or referred to as bed material particles). In that case, the direction of bed material particles in the cracking section may broadly include three kinds: a part of the bed material particles with a larger particle size formed by the bonding of surface coke layer flows to a lower part of the coupled reactor under the action of gravity and enters the gasification section to carry out the gasification reaction; a part of the bed material particles (which is usually particles with a smaller particle size) entrained in the light oil-gas and the syngas enters the gas-solid separation system; and a part of the bed material particles remains in the cracking section and continues to act as reaction carriers.

In that case, the bed material particles entrained in the light oil-gas and the syngas enter the gas-solid separation system to be separated by the gas-solid separation system, then collected and divided into two parts, where a part of the bed material particles is returned to the cracking section and continues to act as reaction carriers of the cracking section, formed a first-stage circulation; and a part of the bed material particles is returned to the gasification section for the gasification reaction to produce syngas, formed a second-stage circulation. By collecting this part of bed material particles and performing the first-stage circulation and the second-stage circulation, the utilization rate of the bed material and coke attaching to the surface of the bed material can be improved, the yield of light oil and syngas can be further improved, and efficiency of heavy oil cracking and cogeneration of syngas can be improved.

In the present disclosure, a corresponding solid phase channel may also be provided between the cracking section and the gasification section of the coupled reactor to facilitate the passage of the abovementioned particles with a larger particle size from the cracking section into the gasification section. For example, in an embodiment, a solid phase channel may be provided on the outside of the coupled reactor, and the abovementioned particles with a larger particle size go downward and enter the gasification section mainly through the solid phase channel provided on the outside of the coupled reactor, i.e., the coke produced in the cracking section is carried by the bed material downward into the gasification section through the solid phase channel on the outside of the coupled reactor.

The aforementioned bed material particles going downward from the cracking section into the gasification section and bed material particles entering the gasification section via the second-stage circulation undergo a gasification reaction in the gasification section, the coke attached to the surface of the bed material particles is converted into syngas rich in hydrogen, carbon monoxide and other small active molecules, and the regenerated bed material is obtained at the same time, the regenerated bed material is returned to the cracking section for recycling. In an embodiment of the present disclosure, the regenerated bed material can be entrained by the syngas and goes upward inside the coupled reactor into the cracking section to realize the regeneration and recycling of the regenerated bed material, which further simplifies the process.

With the generation of syngas in the gasification section, the syngas (with some solid particles (including regenerated bed material)) goes upward as a solid heat carrier (reaction carrier/bed material) fluidizing gas and enters the cracking section, which provides heat required for the cracking reaction on the one hand, so that utilization of heat in two reaction areas of cracking and gasification can be matched and overall energy efficiency can be improved, and provides reaction atmosphere for the cracking reaction on the other hand, which can suppress coking reaction in the heavy oil cracking process to certain extent, improve the yield and the quality of light oil, and meanwhile reduce the yield of coke and improve distribution of products of heavy oil cracking.

As mentioned above, as the cracking reaction proceeds, the generated coke attaches to the surface of the bed material, making the bed material to form solid particles with different particle sizes, and these solid particles can continue to be used as reaction carriers after a series of circulations (such as the first-stage circulation, the second-stage circulation, recycling of regenerated bed material and the like).

In the present disclosure, the light oil-gas and the syngas (with some bed material particles entrained therein) may enter the gas-solid separation system from the cracking section through a channel such as a pipeline and the like. Generally, the light oil-gas and the syngas may be guided upward into a gas-solid separation system for convenience. For example, a channel connected to the gas-solid separation system may be provided in an upper part or the top of the coupled reactor to facilitate the light oil-gas and the syngas going upward from the cracking section into the gas-solid separation system.

The present disclosure may include, but is not limited to, the following two gas-solid separation methods for the light oil-gas and syngas entering a gas-solid separation system.

In one embodiment, subjecting the light oil-gas and the syngas in the gas-solid separation system to the first-stage gas-solid separation and a second-stage gas-solid separation sequentially, first-stage bed material particles and second-stage bed material particles are separated out in sequence, and the purified oil-gas product is collected; the first-stage bed material particles are returned to the cracking section to form the first-stage circulation; and the second-stage bed material particles are returned to the gasification section to form the second-stage circulation; wherein, a particle size of the first-stage bed material particles is greater than a particle size of the second-stage bed material particles.

The abovementioned gas-solid separation system may include a first gas-solid separation apparatus and a second gas-solid separation apparatus arranged in series, where the first gas-solid separation apparatus is configured to receive to-be-separated material flow (light oil-gas, syngas, and bed material particles entrained therein) entering the gas-solid separation system. The first gas-solid separation apparatus performs a first-stage gas-solid separation to the to-be-separated material flow, and then outputs the preliminarily purified oil-gas product therefrom to the second gas-solid separation apparatus for a second-stage gas-solid separation.

Specifically, after the to-be-separated material flow enters the abovementioned gas-solid separation system, the first-stage gas-solid separation is firstly performed in the first gas-solid separation apparatus to obtain preliminarily purified oil-gas product and the first-stage bed material particles, the first stage bed material particles may be returned to the cracking section through a channel such as a pipeline (or other suitable material returning systems) to form the first-stage circulation. Preliminarily purified oil-gas product enters the second-stage gas-solid separation apparatus and undergoes the second-stage gas-solid separation to obtain a purified oil-gas product and the second-stage bed material particles, the second stage bed material particles may be returned to the gasification section through a channel such as a pipeline (or other suitable material returning systems) to form the second-stage circulation. The purified oil-gas product enters a fractionating apparatus for further fractionation processing so as to obtain products such as syngas, liquefied gas, and other high-quality oil-gas.

In that case, separation parameters of the first gas-solid separation apparatus and the second gas-solid separation apparatus may be limited, such that a particle size of the first-stage bed material particles is greater than a particle size of the second-stage bed material particles. In an embodiment, the particle size of the first-stage bed material particle is a, and $30 \leq a \leq 200$ μm; the particle size of the second-stage bed particles is b, and $5 < b < 30$ μm.

The abovementioned first gas-solid separation apparatus may be one or more cyclone separators that are connected in series or parallel with each other, and the second gas-solid separation apparatus may be one or more cyclone separators that are connected in series or parallel with each other.

The bed material particles entering the gas-solid separation system are graded by the abovementioned first-stage gas-solid separation and second-stage gas-solid separation to ensure as far as possible that bed material particles involved in the gasification reaction have a relatively small particle size, so as to be able to improve a conversion rate of the bed material particles in the gasification reaction, and thus improving production and quality of the syngas. Subsequently, the syngas goes upward to the cracking section, which not only ensures that a large amount of heat is transferred to the cracking section, but also enables the cracking reaction to be carried out in a hydrogen-rich environment, and thus improving the quality of the light oil-gas.

In another embodiment, subjecting the light oil-gas and the syngas in the gas-solid separation system to the first-stage gas-solid separation, and the bed material particles collected are sent back to the cracking section and the gasification section, respectively, through a material returning and distributing mechanism by means of fluidizing gas blowback, to form the first-stage circulation and the second-stage circulation.

In that case, first-stage gas-solid separation may be carried out by using one or more cyclone separators connected in series or parallel with each other, and the collected bed material particles are firstly gathered in the material returning and distributing mechanism, and then enter the cracking section and the gasification section respectively by means of fluidizing gas blowback, to form the first-stage circulation and the second-stage circulation.

The abovementioned fluidizing gas may be one or more of water vapor, nitrogen, and syngas generated by the present disclosure. If the syngas of the present disclosure is used as the fluidizing gas, the syngas output from the gas-solid separation system may be collected and a part of the syngas can be used as the fluidizing gas. Along with the first-stage circulation and the second-stage circulation, the syngas will eventually enter the coupling reactor to be collected, which not only reduces the cost of heavy oil cracking, but also improves utilization efficiency of the syngas and reduces energy consumption.

In addition, a ratio of bed material particles in the first-stage circulation to that in the second-stage circulation may be controlled by controlling a blowback gas velocity of the abovementioned fluidizing gas, and thus the efficiency of reactions occurring in the cracking section and the gasification sections can be controlled. In an embodiment of the present disclosure, in order to ensure that the syngas generated in the gasification section has positive effects on the cracking reaction, a blowback gas velocity of the fluidizing gas may be 0.2-3.0 m/s.

The present disclosure also defines the following process parameters of the coupled reactor in order to further match the material flow and energy flow in the heavy oil processing, and to ensure the stability of entire heavy oil processing process and improve the overall energy efficiency.

In the cracking section, a reaction temperature of the cracking reaction is 450-700° C., an agent-oil ratio is 4-20, a reaction time is 1-20 s, and an apparent gas velocity is 1-20 m/s, where the agent-oil ratio is a mass ratio between the amount of bed material added and the amount of heavy oil feedstock added. Generally, the heavy oil feedstock may be preheated to 220-350° C. before entering the cracking section, so as to further improve the cracking efficiency.

In the gasification section, a reaction temperature in the gasification reaction is 850-1200° C., a reaction pressure is atmospheric pressure, an apparent gas velocity is 0.1-5.0 m/s, and residence time is 1-20 min. Where, the apparent gas velocity of the gasification section refers to an apparent gas velocity of a gas collection of a gasification agent used in the gasification reaction and fluidizing gas used to fluidize the bed material particles in the reaction section.

In addition, the abovementioned gasification agent used in the gasification reaction may generally be supplied into the gasification section from outside of the coupled reactor. Specifically, the gasification agent may be one or more of water vapor, oxygen, oxygen-enriched air and air.

The abovementioned reaction conditions can ensure a smooth progress of the gasification reaction, and help to reasonably distribute the bed material particles in the cracking section (generally, a small part of the bed material particles entrained in the light oil-gas and the syngas enters the gas-solid separation system, a large part of the bed material particles acts as a reaction carrier in the cracking section, and a small part of the bed material particles goes downward into the gasification section), so as to ensure stability of entire process.

In order to further improve integrated reaction effects of the cracking section and the gasification section and to improve the stability of the reaction process, in an embodiment of the present disclosure, before the coke is carried by the bed material downward into the gasification section in the lower portion of the cracking-gasification coupled reactor, the method further comprises performing a steam stripping processing and a particle size refining processing sequentially to the downward bed material particles.

Specifically, a steam stripping section and a particle size refining section may be provided between the cracking section and the gasification section of the coupled reactor to perform the steam stripping and particle size refining processing sequentially to the bed material particles going downward from the cracking section. As such, oil-gas on the surface of the downward bed material particles can be removed by the steam stripping, and the bed material particles after the steam stripping processing can be cut and refined by the particle size refining processing, and thus avoiding the agglomeration of the bed material particles and further improving the yield of syngas.

In addition, by providing the aforementioned steam stripping section and particle size refining section between the cracking section and the gasification section, it can also be ensured that the cracking section and the gasification section have relatively independent reaction environments, which further avoids agglomeration and growth of the bed material particles, and ensures stability and safety of entire heavy oil upgrading processing.

Further, when performing the abovementioned steam stripping, a mass ratio of water vapor to the heavy oil feedstock may be controlled to be 0.1-0.3, a temperature of the water vapor to be 200-400° C., and an apparent gas velocity of the water vapor to be 0.5-5.0 m/s. Under the processing conditions, oil-gas on the surface of the bed material particles that going downward from the cracking section into the gasification section can be removed, and the water vapor in the steam stripping together with the upward syngas may provide power for the abovementioned to-be-separated material flow to enter the gas-solid separation system.

In the present disclosure, a washing section may be added to the upper portion of the cracking section of the coupled reactor, so that the to-be-separated material flow in the coupled reactor undergoes a washing processing before entering the gas-solid separation system. Specifically, before the to-be-separated material flow enters the gas-solid separation system, the to-be-separated material flow may be washed and cooled down by the washing section that contains low-temperature liquid, which can remove part of bed material particles in the to-be-separated material flow on one hand and make the removed bed material particles fall back to the cracking section to continuously serve as reactive carriers, and can cool down the to-be-separated material flow on the other hand, so as to avoid the to-be-separated material flow continuously coking in a high-temperature state in the gas-solid separation system, and thus further improving the quality of the light oil-gas product and avoid blocking of the gas-solid separation system caused by excessive coking.

In that case, the low-temperature liquid may be a liquid conventionally used in the field, or can be the heavy oil feedstock used in the present disclosure. For example, in an embodiment, the heavy oil feedstock may enter the cracking section in two ways, in one way the heavy oil feedstock directly contacts with the fluidized bed material for the catalytic cracking reaction, and in the other way the heavy oil feedstock serves as the low-temperature liquid and firstly passes through the abovementioned washing section for heat exchange, and then goes downward to contact with the fluidized bed material for the catalytic cracking reaction, which can further reduce the required energy consumption.

In the present disclosure, the bed material may generally contain an inert carrier, and certainly, some of other solid particles (for example, an active catalyst, such as the cracking catalyst of the present disclosure, a gasification catalyst with catalytic activity for the gasification reaction as described below or the like) may be added as reaction carriers as required and involved in a circulation process of the integrated process of the present disclosure, the solid particles added may also be regarded as component of the bed material of the present disclosure. In a specific embodiment, the aforementioned inert carrier may be one or more of coke powder, quartz sand and other materials, and preferably, using coke powder as the bed material.

In the present disclosure, generally, a distribution range of the particle size of the bed material may be 10-500 μm, and further 20-200 μm, preferably the bed material has a microspheric structure, to have a good fluidization performance, which is conducive to the reaction.

Generally, the abovementioned cracking catalyst may generally include a silica-aluminum material having catalytic effects on the cracking reaction of heavy oil feedstock, a fluid catalytic cracking (FCC) industrial balancer/waste agent, or the like. Where, the silicon-aluminum material may be kaolin, clay (or modified clay), alumina, silica sol, montmorillonite, illite or the like, may also be a silicon-aluminum microspheric catalyst (or silicon-aluminum microspheric contact agent) or the like. In an embodiment, a silicon-aluminum microsphere contact agent with a microreactive index about 10-20 is used as a cracking catalyst, which has a good cracking reaction performance and can achieve a higher yield and quality of light oil-gas products. Addition of the abovementioned cracking catalysts can not only improve efficiency of the cracking reaction, but also serve as a bed material to provide a reaction carrier for the cracking reaction.

In an embodiment, the amount of cracking catalyst added may account for 0.5%-5% (by mass) of the total amount of the bed material, which can effectively improve efficiency of the cracking reaction.

The cracking catalyst of the present disclosure is generally injected into the coupled reactor through the cracking section. The ways of the cracking catalyst being injected into the coupled reactor include, but not limited to, one or more of the following: 1) mixing a cracking catalyst with the heavy oil feedstock and then injecting into the cracking section together, where, a mass of the cracking catalyst mixed with the heavy oil feedstock may typically be 0.5%-5% of a mass of the heavy oil feedstock; 2) injecting separately into the cracking section (for example, a cracking catalyst injecting port, a injecting pipeline or the like may be provided in the cracking section); and 3) enter the cracking section through the first-stage circulation (for example, a cracking catalyst injecting port, a injecting pipeline or the like may be provided in the first-stage circulation).

As abovementioned, in the present disclosure, a gasification catalyst that is catalytically active for the gasification reaction may also be added to the coupled reactor to further improve the efficiency of the gasification reaction and the yield of syngas, and thus further enhancing processing capacity of entire coupled reaction system. Generally, the amount of gasification catalyst added is 0.05-0.3 (by mass) of the total amount of bed material, and the ways of the gasification catalyst entering the gasification section may include one or more of the following: 1) providing a gasification catalyst inlet at the gasification section; 2) providing a gasification catalyst inlet in the second-stage circulation; 3) providing a gasification catalyst inlet, and the like in the abovementioned solid phase channel through which the bed material particles with large particle size going downward from the cracking section into the gasification section.

Generally, the abovementioned gasification catalyst may include one or more of a natural ore, a synthetic material and a derivative compound, which contain a single metal or a combination of multiple metals of an alkali metal, an alkaline-earth metal and Group VIII metal, and an industrial solid waste, such as sludge, slag and blast-furnace dust, which is rich in an alkali metal and an alkaline-earth metal). For example, in an embodiment, an alkaline metal salt compound may be used as the gasification catalyst, where, the compound is composed mainly of potassium carbonate (with content of about 91.5%), with the rest are a carbonate of calcium, magnesium and the like, which can achieve good catalytic efficiency.

In the present disclosure, generally, Conradson carbon residue of the heavy oil feedstock is larger than or equal to 8%, and the integrated method of the present disclosure has good processing effects on such heavy oil feedstock, which can achieve a higher yield and quality of oil-gas products, such as light oil-gas, syngas and the like. The abovementioned heavy oil feedstock may specifically be one heavy oil or a heavy oil mixture of any proportion, such as thickened oil, highly thickened oil, oil sand asphalt, atmospheric residual oil, vacuum residual oil, catalytic cracking slurry, solvent deoiled asphalt or the like, or may be one derived heavy oil or a derived heavy oil mixture of any proportion, such as heavy tar and residual oil in a coal pyrolysis or a liquefaction process, heavy oil produced by retorting oil shale, a low-temperature pyrolysis liquid product in biomass or the like.

The present disclosure further provides an integrated apparatus for catalytic cracking of heavy oil and production of syngas configured to implement the abovementioned integrated method, including:

a cracking-gasification coupled reactor, including a cracking section and a gasification section that are internally connected with each other, and an oil-gas outlet located on top of the cracking-gasification coupled reactor and connected with the cracking section; the cracking section is located above the gasification section; the cracking section is provided with a feedstock inlet and a first solid phase inlet; the gasification section is provided with a second solid phase inlet;

a gas-solid separation system, including a material inlet, a gas phase outlet and a solid phase outlet; and a fractionating tower, including a fractionating tower inlet and multiple light component outlets;

wherein the gas-solid separation system is located outside the cracking-gasification coupled reactor, the oil-gas outlet of the cracking-gasification coupled reactor is connected with the material inlet of the gas-solid separation system, the first solid phase inlet and the second solid phase inlet are connected respectively with the solid phase outlet of the gas-solid separation system, and the gas phase outlet of the gas-solid separation system is connected with the fractionating tower inlet.

Further, the abovementioned gas-solid separation system includes a first gas-solid separator and a second gas-solid separator, the first gas-solid separator includes a first material inlet, a first gas phase outlet and a first solid phase outlet, and the second gas-solid separator includes a second material inlet, a second gas phase outlet and a second solid phase outlet, where, the oil-gas outlet of the cracking-gasification coupled reactor is connected with the first material inlet, the first gas phase outlet is connected with the second material inlet, and the second gas phase outlet is connected with the fractionating tower inlet;

the first solid phase outlet is connected with the first solid phase inlet of the cracking section; the second solid phase outlet is connected with the second solid phase inlet of the gasification section.

Compared with the prior art, the present disclosure can achieve the following beneficial effects.

(1) The present disclosure gives full play to a synergistic effect between two reactions of heavy oil cracking and coke gasification. On the one hand, the coke generated in the cracking section serves as a reactive material of the gasification section for the gasification reaction in the gasification section to generate high-quality syngas, which avoids generation of a petroleum coke and enriches hydrogen sources of a refinery; on the other hand, the syngas generated in the gasification reaction goes upward to the cracking section, which not only provides heat for the cracking reaction, but also provides reaction atmosphere for heavy oil cracking; such that energy efficiency can be further improved and energy consumption can be further reduced, especially in the presence of a cracking catalyst. Therefore, mutual supply of materials and complementary of energy between the two reactions are realized in the integrated method of the present disclosure by the above processes, and thus reducing energy consumption and realizing technical advantages of for example, a catalytic cracking of light oil and syngas co-production.

(2) The present disclosure proposes an integrated method for catalytic cracking of heavy oil and production of syngas and an integrated reaction apparatus thereof, by integrating the heavy oil cracking section in the upper portion and the coke gasification section in the lower portion in the same reaction system, problems such as difficult in circulation operations among multiple reactors, complex process, large footprint, high investment and the like in flexible coking processing are avoided, which further improves energy efficiency and technical economy of the method.

BRIEF DESCRIPTION OF DRAWING(S)

DESCRIPTION OF REFERENCE NUMERALS

1: cracking section; 2: gasification section; 3: gas-solid separation system; 4: fractionating tower; 5: steam stripping section; 6: particle size refining section; 7: atomizing device; 8: washing section; 9: solid phase channel; 10: preheating mixer; 11: material returning and distribution mechanism; 31: first gas-solid separator; 32: second gas-solid separator; 100: cracking-gasification coupled reactor; a: gasification agent; b: solid ash; c: heavy oil feedstock; d: cracking catalyst; e: syngas; f: to-be-separated material flow; g: first-stage bed material particles; h: preliminary purified oil-gas product; i: second-stage bed material particles; j: purified oil-gas product; k: gasification catalyst; m: bed material particles of first-stage circulation; n: bed material particles of second-stage circulation; o: fluidized gas.

DESCRIPTION OF EMBODIMENTS

Content of the present disclosure is described more specifically below in combination with the following embodiments. It should be understood that the embodiment of the present disclosure is not limited to the following embodiments, and any formal adaptations and/or changes made to the present disclosure will fall within the scope of protection of the present disclosure.

The following embodiments, unless otherwise indicated, may be implemented by using conventional apparatus/instruments/structures/components or the like in the art.

Embodiment 1

Figure 1:
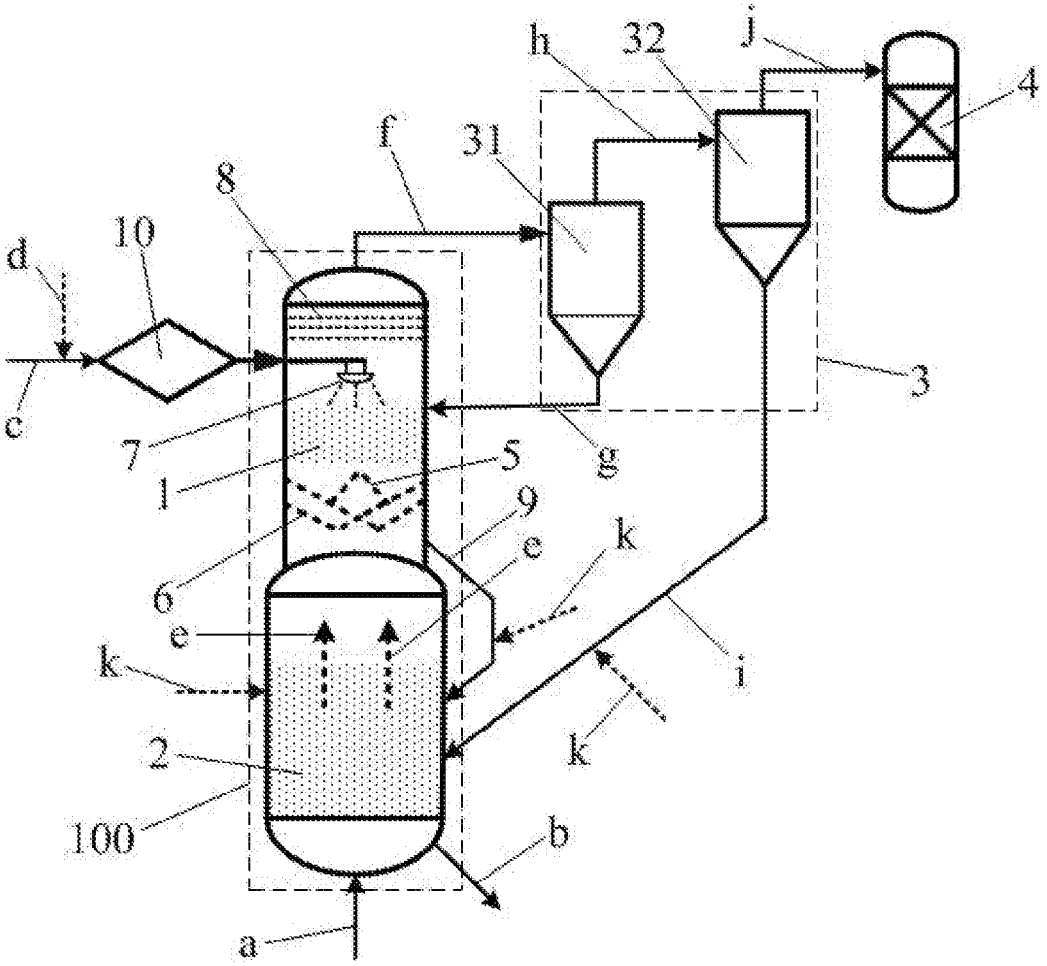
FIG. 1 is a schematic diagram of an integrated apparatus for catalytic cracking of heavy oil and production of syngas in an embodiment of the present disclosure.

FIG. 1 is a schematic diagram of an integrated apparatus for catalytic cracking of heavy oil and production of syngas in an embodiment of the present disclosure, the apparatus includes at least:

a cracking-gasification coupled reactor 100, including a cracking section 1 and a gasification section 2 that are internally connected to each other and an oil-gas outlet located on the top of the cracking-gasification coupled reactor 100 and connected with the cracking section 1; the cracking section 1 is located on an upper portion of the gasification section 2; the cracking section 1 is provided with a feedstock inlet, a first solid phase inlet; the gasification section 2 is provided with a second solid phase inlet; wherein the feedstock inlet of the cracking section 1 leads directly to the fluidized bed material;

specifically, the abovementioned cracking-gasification coupled reactor 100 may specifically be obtained by suitable modification and assembly of a cracking reactor and a gasification reactor commonly used in the art. Where, the cracking reactor may, for example, be a fluidized bed reactor, the bottom end of which is interconnected with the top end of the gasification reactor. Preferably, the cracking reactor and the gasification reactor are installed coaxially to facilitate the transport and circulation of materials;

as such, the cracking section 1 may include a fluidized bed, such that solid particles such as bed material of the cracking section 1 can stay in a fluidized state by the action of the fluidized bed, and serve as carriers for the cracking reaction;

the gasification section 2 may include a fluidized bed, such that solid particles such as bed material of the gasification section 2 can stay in a fluidized state by the action of the fluidized bed, and contact with a gasification agent a for gasification reaction; the gasification section 2 is also provided with a gasification agent inlet for injecting the gasification agent a and a slag outlet for the output of impurities that cannot be reactively transformed such as solid ash b;

a gas-solid separation system 3, including a first gas-solid separator 31 and a second gas-solid separator 32; where the first gas-solid separator 31 includes a first material inlet, a first gas phase outlet and a first solid phase outlet, and the second gas-solid separator 32 includes a second material inlet, a second gas phase outlet and a second solid phase outlet; and a fractionating tower 4, including a fractionating tower inlet and multiple light component outlets;

where the gas-solid separation system 3 is located outside the cracking-gasification coupled reactor 100, the oil-gas outlet of the cracking-gasification coupled reactor 100 is connected with the first material inlet, the first gas phase outlet is connected with the second material inlet, and the second gas phase outlet is connected with the fractionating tower inlet; the first solid phase outlet is connected with the first solid phase inlet of the cracking section 1; and the second solid phase outlet is connected with the second solid phase inlet of the gasification section 2.

The abovementioned first gas-solid separator may be one or more cyclone separators connected in series or parallel with each other, and the second gas-solid separator may be one or more cyclone separators connected in series or parallel with each other.

On the abovementioned basis, the interior of the cracking-gasification coupled reactor 100 of FIG. 1 further includes:

a steam stripping section 5, the steam stripping section 5 may include a steam stripping baffle, thereby removing oil-gas from the surface of bed material particles in the downward process by injecting vapor;

a particle size refining section 6, the particle size refining section 6 may include a steam jet grinder that grinds the bed material particles after steam stripping by injecting vapor;

an atomizing apparatus 7, which is located in the cracking section 1 and is connected with the feedstock inlet of the cracking section 1, and configured to atomize the heavy oil feedstock c;

a washing section 8, which is provided above the cracking section 1 and is connected with the cracking section 1, and configured to wash and cool down a to-be-separated material flow f that is about to enter the gas-solid separation system 3, and remove part of bed material particles in the to-be-separated material flow f.

In addition, a solid phase channel 9 is also provided between the cracking section 1 and the gasification section 2 of the cracking-gasification coupled reactor 100, the solid phase channel 9 is located on the outside of the cracking-gasification coupled reactor 100, and a feedstock inlet of the solid phase channel 9 is located below a particle size refining section 6, configured to lead bed material particles refined and grinded by the particle size refining section 6 downward into the gasification section 2.

The cracking-gasification coupled reactor 100 also includes a preheating mixer 10 on the outside, the preheating mixer 10 is provided with a heavy oil feedstock inlet, a first catalyst inlet and a feedstock outlet, where, the feedstock outlet of the preheating mixer 10 is connected with the feedstock inlet of the cracking section 1, so that the heavy oil feedstock and a cracking catalyst d are mixed and preheated in the preheating mixer 10, and then enter the cracking section 1.

An integrated method for catalytic cracking of heavy oil and production of syngas by using the integrated apparatus provided in the present embodiment is briefly described as follows.

The heavy oil feedstock c and the cracking catalyst d are fed into the preheating mixer 10 respectively through the heavy oil feedstock inlet and the first catalyst inlet of the preheating mixer 10, and then transferred to the cracking section 1 after being fully mixed and preheated, contacting with fluidized bed material for a catalytic cracking reaction after being atomized by the atomization apparatus 7, to obtain light oil-gas and coke respectively. The coke is attached to the surface of the bed material particles, and thus forming bed material particles with different particle sizes. A part of heavily coked bed material particles goes downward under the action of gravity, and during the downward process, the light oil-gas remaining on the surface of the bed material particles is removed firstly through the steam stripping section 5, and then the bed material particles is cut and refined by a particle size refining section 6. Finally, cut and refined bed material particles go downward through the solid phase channel 9 to the gasification section 2.

In the gasification section 2, the abovementioned refined bed material particles undergo a gasification reaction with the gasification agent that has entered the gasification section 2 via the gasification agent inlet, so as to obtain syngas e and a regenerated bed material. Moreover, the solid ash b that cannot react during a gasification process of bed material particles may be discharged through the slag discharge port from the cracking-gasification coupled reactor 100 after being accumulated. Heavy metals, cracking catalysts and the like in the solid ash b may be recycled by subsequent processes.

With the generation of the syngas, and being driven by the gasification agent a, the syngas e (which carries part of the bed material particles (including the regenerated bed material) during the upward process) goes upward and enters into the cracking section 1, and thus providing reaction heat and reaction atmosphere to the catalytic cracking reaction of heavy oil (the amount of syngas going upward may be controlled by regulating the type of gasification agent, the gas velocity and the like, and thereby ensuring that an internal material flow of the cracking-gasification coupled reactor 100 matches with an energy flow), and then the syngas e merges with the light oil-gas. The to-be-separated material flow f (the light oil-gas, the syngas and bed material particles entrained therein) goes upward, and passes through the washing section 8 to exchange heat with low-temperature liquid in the washing section 8 to cool down the to-be-separated material flow f and remove part of bed material particles from the to-be-separated material flow f, the part of bed material particles removed falls back to the cracking section 1 and continue to act as reactive carriers; after being cooled down by the washing section 8, the to-be-separated material flow f is guided out from the cracking-gasification coupled reactor 100 via the oil-gas outlet, and enter the first gas-solid separator 31 via the first material inlet, where the preliminary separation (the first-stage gas-solid separation) is carried out in the first gas-solid separator 31 to separate out a first-stage bed material particle g (a particle size range of which is a, and $30 \leq a \leq 200$ μm) and the preliminary purified oil-gas product h.

In that case, the first-stage bed material particle g is exported through the first solid phase outlet, and enters the cracking section 1 through the first solid phase inlet to be continuously served as a cracking reaction carrier, and thus forming a first-stage circulation.

After being preliminarily purified, the oil-gas product h is exported through the first gas phase outlet, and enters the second gas-solid separator 32 through the second material inlet for a secondary separation (the second-stage gas-solid separation) in the second gas-solid separator 32, to separate out a second-stage bed material particle i (a particle size range of which is b, and 5<b<30 μm) and a purified oil-gas product j.

As such, the second-stage bed material particles i are exported through the second solid phase outlet, and enters the gasification section 2 through the second solid phase inlet for a gasification reaction, and thus forming a secondary circulation.

It can be understood that, the first-stage bed material particles g of the first-stage circulation and the bed material particles in the cracking section 1 would continue to be recycled after being mixed (a part of mixed bed material particles goes downward into the gasification section 2 as a feedstock of the gasification reaction, a part of mixed bed material particles remains in the cracking section 1 as a cracking reaction carrier, and a part of mixed bed material particles entrained within the light oil-gas and the syngas enters the gas-solid separation system 3); after entering the gasification section 2, the second-stage bed material particle i of the second-stage circulation undergoes a gasification reaction with the abovementioned bed material particles that go downward from the cracking section 1 through the solid phase channel 9 in the gasification section 2, to generate the syngas e, the syngas e will carry part of the bed material particles in the gasification section 2 upward into the cracking section 1.

Purified oil-gas product j is exported through the second gas phase outlet, and enters the fractionating tower 4 through the fractionating tower inlet for fractionation, and thus products, such as light oil, cracked gas (dry gas, liquefied gas or the like) and syngas or the like, would be exported respectively through multiple light fraction outlets of the fractionating tower 4. Certainly, a further separation and fraction may be performed by providing multiple fractionating towers to obtain liquid products with different distillation range components, where, heavy oil (including part of bed material particles and the like) in the bottom of the fractionating tower may be mixed with the heavy oil feedstock c and recirculated into the cracking-gasification coupled reactor 100 for processing.

The conditions for the abovementioned cracking reaction are: a reaction temperature is 450-700° C., a reaction pressure is 0.1 MPa, a reaction time of 1-20 s, and an agent oil ratio is 4 to 20. The heavy oil feedstock may be preheated to 220-350° C. before entering the cracking section.

The conditions for the abovementioned gasification reaction are: a reaction temperature is 850-1200° C., a reaction pressure is 0.1 Mpa, an apparent gas velocity is 0.1-5 m/s, and a residence time of the bed material particles is 1 to 20 min.

The abovementioned gasification agent in the gasification reaction may be one or more of water vapor, oxygen, oxygen-rich air and air.

The conditions for the abovementioned steam stripping processing are: a mass ratio of water vapor to heavy oil feedstock is 0.1-0.3, a temperature of the water vapor is 200-400° C., and an apparent gas velocity of the water vapor in vapor striping is 0.5-5.0 m/s.

In the present embodiment, the bed material particles may include an inert carrier, and certainly, some of other solid particles (for example, the cracking catalyst of the present embodiment, a gasification catalyst which has catalytic activity for the gasification reaction as described below or the like) may be added as reaction carriers as required and involved in a circulation process of the integrated process of the present embodiment, the solid particles added may also be regarded as a component of the bed material of the present embodiment. In a specific embodiment, the aforementioned inert carrier may be one or more of coke powder, quartz sand and other materials, and preferably, using the coke powder as the bed material.

Generally, a particle size distribution range of the abovementioned bed material may be 10-500 μm, and further, 20-200 μm.

The abovementioned cracking catalyst may include one or more of kaolin, clay (or modified clay), alumina, silica sol, montmorillonite, illite, silicon-alumina microspheric contact agent, an FCC industrial balancing agent and the like. In an embodiment, a silicon-aluminum microspheric contact agent with a micro-reactive index of about 10-20 is used as a cracking catalyst.

The amount of the abovementioned added cracking catalyst may account for 0.5%-5% (by mass) of the total amount of the bed material.

Figure 2:
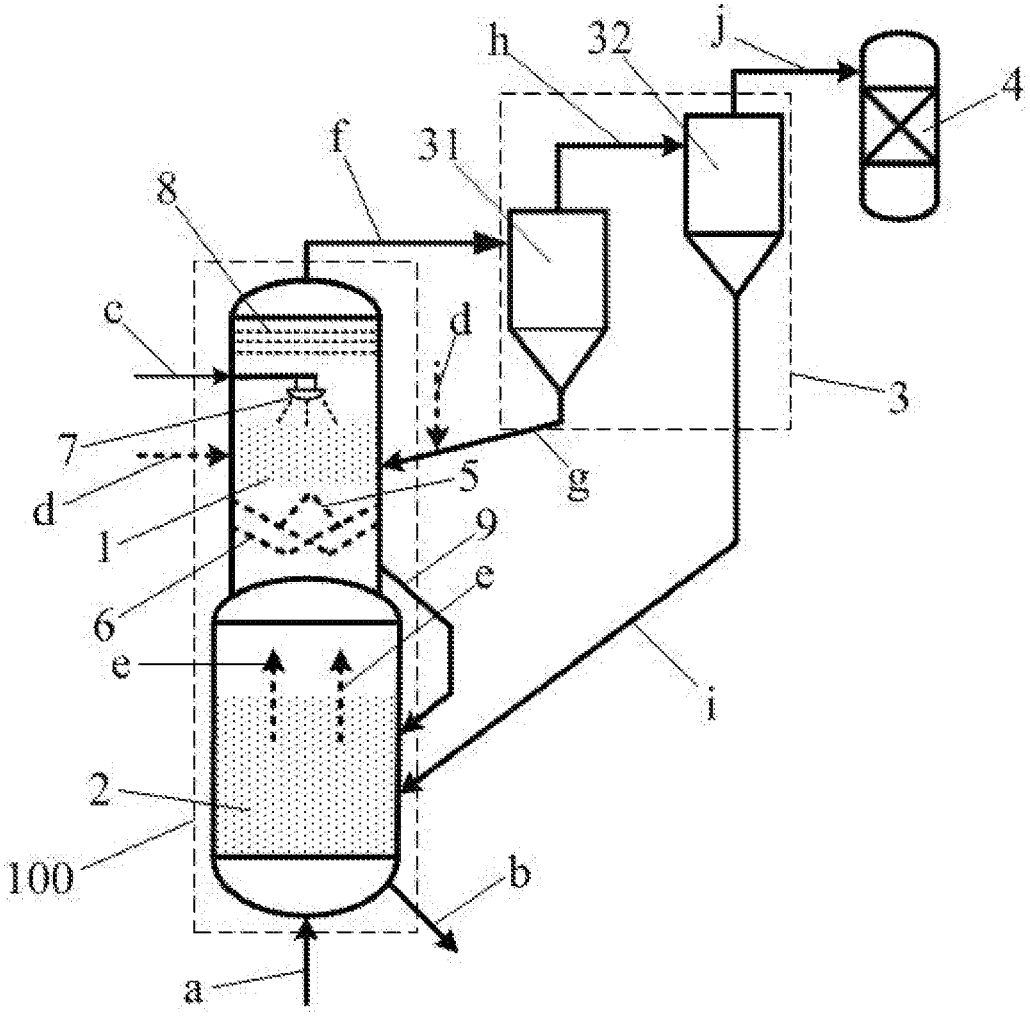
FIG. 2 is a schematic diagram of an integrated apparatus for catalytic cracking of heavy oil and production of syngas in an embodiment of the present disclosure.

In the present embodiment, the amount of the cracking catalyst added to the preheating mixer 10 to be mixed with the heavy oil feedstock is about 0.5%-5% of the amount of added heavy oil. Certainly, depending on the total amount of the cracking catalyst added into the coupled reactor, for example, when the total amount of the added cracking catalyst is greater than the amount of the abovementioned cracking catalyst mixed with the heavy oil feedstock, a remaining part of the cracking catalyst may enter the cracking section by other means in addition to the abovementioned part of the cracking catalyst being mixed with the heavy oil feedstock that enters the cracking section. As shown in FIG. 2, a cracking catalyst inlet may be provided at the cracking section 1 and/or the first-stage circulation for the addition of the remaining part of the cracking catalyst.

In addition, in another embodiment, the heavy oil feedstock may enter the cracking section 1 separately via a feedstock inlet, rather than being preheated and mixed with the cracking catalyst, in that case, the cracking catalyst enters the cracking section 1 by other means. In the integrated apparatus as shown in FIG. 2, no preheating mixer is provided, and the heavy oil feedstock is allowed to enter the cracking section 1 directly via a feedstock inlet, and the cracking catalyst may enter the cracking section 1 through the abovementioned cracking catalyst inlet.

In addition, a gasification catalyst k may be added into the gasification section 2, for example, a corresponding second gasification catalyst inlet may be provided at the gasification section and/or the second-stage circulation and/or the solid phase pass 9 for the addition of the gasification catalyst k. The amount of added gasification catalyst is generally 0.05-0.3 (by mass) of the total amount of the bed material.

Generally, the abovementioned gasification catalyst may include one or more of a natural ore, a synthetic material and a derivative compound, which contain a single metal or a combination of multiple metals of an alkali metal, an alkaline-earth metal or a Group VIII metal, and an industrial solid waste, such as sludge, slag and blast-furnace dust, which is rich in an alkali metal and an alkaline-earth metal.

For example, in an embodiment, an alkaline metal salt compound may be used as the gasification catalyst, where, the compound is composed mainly of potassium carbonate (with content of about 91.5%), with the rest are a carbonate of calcium, magnesium and the like.

In the present embodiment, Conradson carbon residue of the heavy oil feedstock is larger than or equal to 8%. The heavy oil feedstock may be one heavy oil or a heavy oil mixture of any proportion, such as thickened oil, highly thickened oil, oil sand asphalt, atmospheric residual oil, vacuum residual oil, catalytic cracking slurry, solvent deoiled asphalt or the like, or may be one derived heavy oil or a derived heavy oil mixture of any proportion, such as heavy tar and residual oil in a coal pyrolysis or a liquefaction process, heavy oil produced by retorting oil shale, a low-temperature pyrolysis liquid product in biomass or the like.

Embodiment 2

The integrated method and the integration apparatus used in the present embodiment are generally the same as embodiment 1, and thus the following only illustrates the differences between the present embodiment and embodiment 1 without repeating the same part, reference may be made to the details of embodiment 1.

Figure 3:
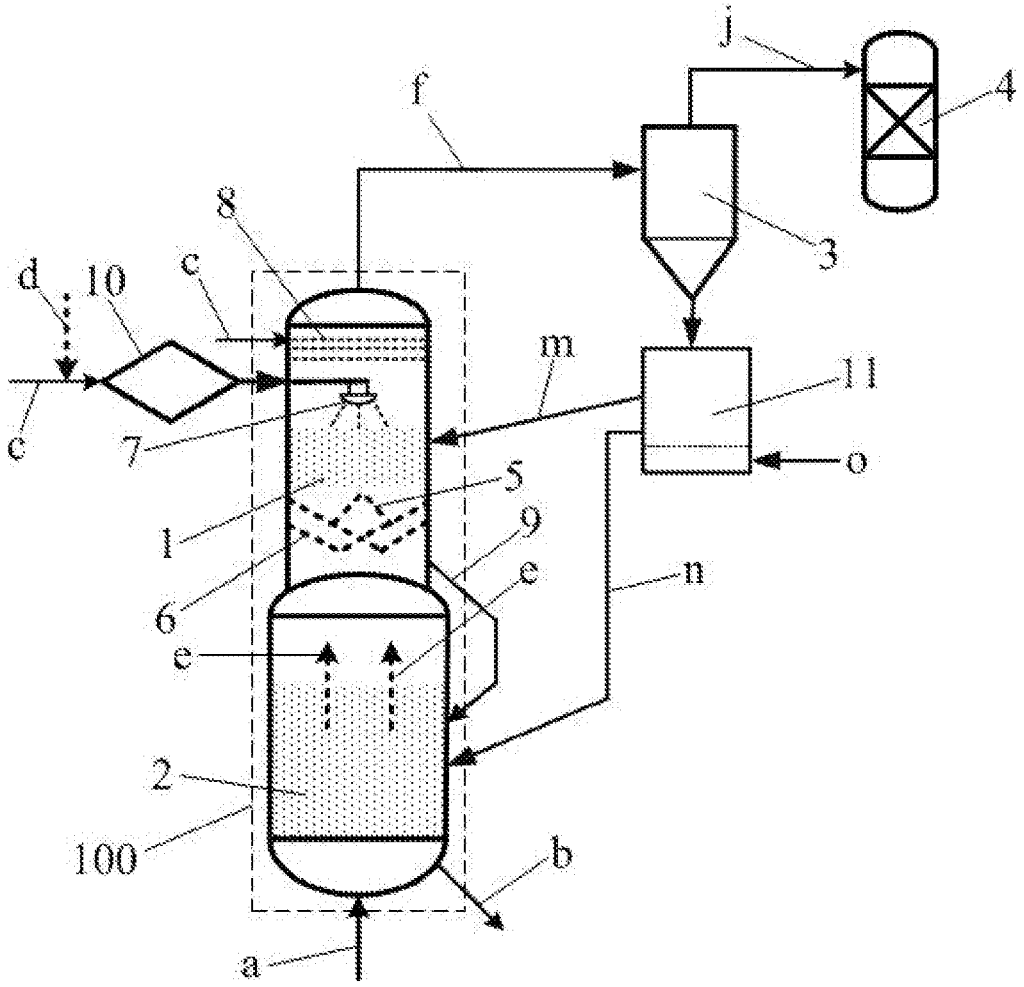
FIG. 3 is a schematic diagram of an integrated apparatus for catalytic cracking of heavy oil and production of syngas in another embodiment of the present disclosure.

FIG. 3 is a schematic diagram of an integrated apparatus for catalytic cracking of heavy oil and production of syngas in the present embodiment, which has differences from the integrated apparatus of embodiment 1 (FIG. 1) as follows.

(1) Heavy oil feedstock inlet: the cracking section 1 of the cracking-gasification coupled reactor 100 includes a first feedstock inlet and a second feedstock inlet (i.e., two feedstock inlets), where the first feed inlet leads directly to the fluidized bed material and the second feed inlet leads to the washing section 8.

(2) Gas-solid separation system 3: the gas-solid separation system 3 includes a material inlet, a gas phase outlet and a solid phase outlet;

in that case, the gas-solid separation system 3 is located outside the cracking-gasification coupled reactor 100, with the oil-gas outlet of the cracking-gasification coupled reactor 100 being connected with the material inlet, the first solid phase inlet of the cracking section 1 and the second solid phase inlet of the gasification section 2 being connected respectively with the solid phase outlet of the gas-solid separation system 3, and the gas-solid phase outlet of the gas-solid separation system 3 being connected to the fractionating tower inlet.

Furthermore, a material returning and distributing mechanism 11 is also provided outside the cracking-gasification coupled reactor 100 between the gas-solid separation system 3 and the cracking-gasification coupled reactor 100, with the solid phase outlet of the gas-solid separation system 3 being connected respectively with the first solid phase inlet and the second solid phase inlet via the material returning and distributing mechanism 11. The material returning and distributing mechanism 11 includes a material returning inlet and a material returning outlet, with the material returning inlet being connected with the solid phase outlet of the gas-solid separation system 3, and the material returning outlet being connected with the first solid phase inlet and the second solid phase inlet respectively.

The abovementioned first gas-solid separator may be formed by one or more cyclone separators connected in series or in parallel to each other.

The differences between the integration method of the present embodiment and embodiment 1 are briefly described as follows.

(1) Heavy oil feedstock c enters the cracking-gasification coupled reactor in two paths: the heavy oil feedstock c is divided into two parts, where, one part of the heavy oil feedstock c is preheated and mixed with the cracking catalyst d in the preheating mixer 10 and transported to the cracking section 1 via the first feedstock inlet, and then contacts with the fluidized bed material for a catalytic cracking reaction after being atomized by the atomization apparatus 7; the other part of the heavy oil feedstock c is fed into the cracking-gasification coupled reactor 100 via the second feedstock inlet, and firstly passes through the washing section 8 for heat exchange with the to-be-separated material flow f which is about to enter the gas-solid separation system 3, and then goes downward into the cracking section 1, and contacts with the fluidized bed material for catalytic cracking reaction.

(2) The to-be-separated material flow f cooled down by the washing section 8 is led out from the cracking-gasification coupled reactor 100 through the oil-gas outlet and enters the gas-solid separation system 3 through the material inlet.

The gas-solid separation system 3 of the present embodiment is a first-stage gas-solid separation (only one gas-solid separation), and the separated bed material particles are exported through the solid phase outlet and enter the material returning and distributing mechanism 11 through the material returning inlet, and enter the cracking section 1 and the gasification section 2 respectively in two paths separately from the material returning outlet under the blowback action of the fluidizing gas o, where the bed material particles entering the cracking section 1 through the first solid phase inlet are first-stage circulation bed particles m, and the bed material particles entering the gasification section 2 through the second solid phase inlet are second-stage circulation bed particles n.

The abovementioned fluidizing gas o may include a mixture of one or more gases of water vapor, nitrogen, or syngas generated in the present disclosure. A blowback gas velocity of the fluidizing gas is 0.2-3.0 m/s.

Application Embodiment

In order to illustrate effects of the present disclosure, the Venezuelan vacuum residual oil was tested by using the apparatus and process shown in embodiment 1.

Test 1. Coke powder was used as the bed material; no cracking catalyst and gasification catalyst were added.

Test 2. Coke powder with silica-aluminum microspheric contact agent (about 5% of the total bed material) as bed material, no gas catalyst was added.

Test 3. Coke powder and alkaline metal salt compounds (about 5% of the total bed material) were used as the bed material; no cracking catalyst was added.

The properties of the heavy oil feedstock used in the present application embodiment are shown in Table 1. The heavy oil feedstock has high oil density, high residual carbon value, low H/C ratio, high contents of asphaltene and heavy oil fraction greater than 500° C., and contains high contents of sulfur, nitrogen and heavy metal components, and has a serious tendency to coke in the traditional catalytic cracking process, which is prone to lead to inactivation of catalyst due to rapid coke deposition or heavy metal poisoning.

TABLE 1

| Sample name | Venezuelan residual oil |
|---|---|
| Density (20° C.)/g · cm$^{-3}$ | 1.0251 |
| Kinematic viscosity (100° C.)/mm$^2$ · s$^{-1}$ | 4080 |
| Conradson carbon residue/wt % | 21.15 |
| C/wt % | 84.74 |
| H/wt % | 9.96 |
| S/wt % | 0.75 |
| N/wt % | 3.64 |
| n(H)/n(C) | 1.41 |
| Saturate/wt % | 19.14 |
| Aromatics/wt % | 43.75 |
| Colloid/wt % | 24.7 |
| Asphaltene/wt % | 12.41 |
| Ni/ppm | 99 |
| V/ppm | 423 |
| Initial boiling point | 357 |
| 10% | 394 |
| 30% | 477 |
| 50% | 558 |
| 70% | 636 |
| 90% | 701 |
| Final boiling point | 795 |
| VGO ratio (350-500° C.) | 36.00% |
| Heavy oil fraction ratio (>500° C.) | 64.00% |

The coke powder used in this application example has a particle size of 20-120 μm, which is mainly fixed carbon, with a dense carbon layer structure on the surface, and the specific composition of components is shown in Table 2 (which may be determined by conventional industrial analysis).

A silica-aluminum microspheric contact agent used in the present application embodiment (which may be homemade using conventional methods) has a particle size distribution of 20-100 μm and a micro-reactivity index about 10-20, and the specific composition of components is shown in Table 2 (which may be determined by an X-ray fluorescence spectroscopy (XRF) analytical method, where an excited sample is measured, and the type and content of the various elements are finally obtained according to specific energy and wavelength characteristics of secondary X-rays emitted by different elements), where, alkali metal oxides are mainly $Na_2O$ and $K_2O$, and the other components are mainly MgO, $Fe_2O_3$ and a small amount of rare earth metal oxides.

The main component of the alkaline metal salt compounds used in the present application embodiment is potassium carbonate (content of about 91.5%), and the rest are carbonates of calcium, magnesium and the like.

TABLE 2

| | Ash | Fixed carbon | | Volatile component |
|---|---|---|---|---|
| Coke powder (wt %, dry basis) | 0.63 | 91.42 | | 7.95 |
| | Aluminum oxide | Silicon dioxide | Alkali metal oxide | Other components |
| Silicon-aluminum microspheric contact agent (wt. %) | 26.79 | 67.38 | 0.56 | 3.02 |

In addition, other reaction parameters of the present application embodiment are listed in Table 3.

TABLE 3

| | Temperature | Reactive time | Ratio of agent to oil | Pressure | Apparent gas velocity |
|---|---|---|---|---|---|
| Cracking reaction | 476° C. | 16 s | 7.5 | 0.1 MPa | 2.5 m/s |
| | Temperature | Reactive time | Gasification agent | Pressure | Apparent gas velocity |
| Gasification reaction | 850° C. | 600 s | Water vapor + oxygen | 0.1 MPa | 0.2 m/s |
| | Temperature | | Apparent gas velocity of water vapor | Ratio of water vapor to oil | |
| Steam stripping processing | 350° C. | | 1.25 m/s | 0.20 | |

After the processing of the abovementioned heavy oil feedstock in this application embodiment, good cracking product distribution and syngas product distribution were achieved in Test 1-Test 3, where a yield of liquid over 74%, and a yield of syngas (including $H_2$ and CO) over 68% can be achieved, with most of the syngas products being $H_2$.

To further illustrate positive effects of the addition of the cracking catalyst and gasification catalyst, detailed cracking product distribution obtained from Test 1 and Test 2 is presented in Table 4, and detailed gasification syngas product distribution obtained from Test 1 and Test 3 is presented in Table 5.

TABLE 4

| | Experiment No. | |
|---|---|---|
| | Test 1 | Test 2 |
| Yield of gas/wt % | 6.6 | 5.5 |
| Yield of liquid/wt % | 74.5 | 77.0 |
| Yield of coke/wt % | 18.9 | 17.7 |
| Gasoline fraction/wt % | 2.6 | 11.1 |
| Diesel fraction/wt % | 6.9 | 18.1 |
| Vacuum fraction oil/wt % | 40.7 | 34.1 |
| Heavy oil fraction/wt % | 24.3 | 13.1 |

It can be seen from Table 4 that good distribution of cracking products can be obtained in both Test 1 and Test 2, which can significantly improve the yield of light oil and inhibit the production of coke. Compared with the initial residual carbon value of the heavy oil feedstock, a ratio of coke yield to residual carbon is about 0.8-0.9, which is much smaller than a coke/residual carbon ratio of 1.4-1.6 in the delayed coking processing; liquid yields are approximately 74.5% and 77.0% respectively, where the liquid contains some of the heavy oil fractions greater than 500° C., which may be subsequently processed by refining.

However, by comparing the cracking product distributions of Test 1 and Test 2, it can be seen that addition of the silica-aluminum microspheric contact agent with some catalytic activity leads to a higher liquid yield and a lower gas and coke yield, indicating that the introduction of a cracking catalyst with catalytic activity as a bed material resulted in a better cracking performance than an inert carrier such as coke powder, which was mainly used in the thermal cracking reaction alone, as a bed material. The simulated distillation results of the liquid products also indicates that, the heavy oil fraction of the oil products was lower and the light gasoline and diesel fraction was higher when the silicon-aluminum microspheric contact agent was used as the reaction bed material than the coke powder, which proved that the silicon-aluminum microspheric contact agent with a certain activity had better reaction performance in the cracking of heavy oil.

TABLE 5

| | Experiment No. | |
|---|---|---|
| | Test 1 | Test 3 |
| $H_2$/vol % | 46.6 | 54.3 |
| CO/vol % | 34.9 | 14.3 |
| $CO_2$/vol % | 16.1 | 30.7 |
| $CH_4$ and the like vol % | 2.4 | 0.7 |

It can be seen from Table 5 that, the sum of volume fractions of $H_2$ and CO in the syngas obtained in Test 1 is about 82%, with the content of $H_2$ about 47% and the content of CO about 35% in the gas. By comparing Test 3 with Test 1, it can be seen that by adding some of alkali metal salts, the content of $H_2$ in the syngas is increased by 7.7 percentage points due to a catalytic reaction for vapor transformation, which better meets the requirements of the subsequent process for hydrogen preparation. Besides, it should be noted that by adding alkaline metal salts, the reaction time of a gasification reaction in the gasification section in test 3 is reduced by about 40% compared with test 1, and particularly in a forepart of the reaction, the rate of gasification reaction is significantly increased.

Finally, it should be noted that: the above embodiments are merely used for illustrating the technical solutions of the present disclosure, but not being construed as limiting the present disclosure. Although the present disclosure is described in detail with reference to the forgoing embodiments, those ordinary skilled in the art should understand that modifications may still be made to the technical solutions of the forgoing embodiments or equivalent replacements may be made to a part or all of the technical features therein. These modifications or replacements do not make the essence of corresponding technical solutions depart from the scope of the technical solutions of the embodiments of the present disclosure.

What is claimed is:

1. An integrated method for catalytic cracking of heavy oil and production of syngas, wherein a cracking-gasification coupled reactor having a cracking section and a gasification section that are internally connected with each other is used as a reactor, the integrated method comprises:

feeding a heavy oil feedstock into the cracking section in an upper portion of the cracking-gasification coupled reactor to contact with a bed material in a fluidized state that contains a cracking catalyst, a catalytic cracking reaction is conducted under atmospheric pressure to obtain light oil-gas and coke; the coke is carried downward by the bed material into the gasification section in a lower portion of the cracking-gasification coupled reactor to conduct a gasification reaction to generate syngas; the syngas goes upward in the cracking-gasification coupled reactor into the cracking section to merge with the light oil-gas, and is guided out from the coupled reactor to a gas-solid separation system;

subjecting the light oil-gas and the syngas in the gas-solid separation system to at least a first-stage gas-solid separation, and bed material particles separated out are collected and divided into two parts, and returned to the cracking section and the gasification section, respectively, to form a first-stage circulation and a second-stage circulation of the bed material particles accordingly; and performing oil-gas fractionation to a purified oil-gas product output from the gas-solid separation system to collect light oil and syngas products;

wherein, the integrated method, before the coke is carried by the bed material downward into the gasification section in a lower portion of the cracking-gasification coupled reactor, further comprises performing a steam stripping processing and a particle size refining processing sequentially to the downward bed material particles.

2. The integrated method according to claim 1, wherein, subjecting the light oil-gas and the syngas in the gas-solid separation system comprises: the first-stage gas-solid separation and further comprises a sequential second-stage gas-solid separation, wherein first-stage bed material particles and second-stage bed material particles are separated out in sequence and the purified oil-gas product is collected;

the first-stage bed material particles are returned to the cracking section to form the first-stage circulation; and the second-stage bed material particles are returned to the gasification section to form the second-stage circulation; wherein, a particle size of the first-stage bed material particles is greater than a particle size of the second-stage bed material particles; or, subjecting the light oil-gas and the syngas in the gas-solid separation system to the first-stage gas-solid separation, and the bed material particles collected are sent back to the cracking section and the gasification section, respectively, through a material returning and distributing mechanism by means of fluidizing gas blowback, to form the first-stage circulation and the second-stage circulation.

3. The integrated method according to claim 2, wherein, a particle size of the first-stage bed material particles is a, and $30 \leq a \leq 200$ μm; a particle size of the second-stage bed particles is b, and $5 < b < 30$ μm.

4. The integrated method according to claim 1, wherein, a reaction temperature of the cracking reaction is 450-700° C., an agent-oil ratio is 4-20, a reaction time is 1-20 s, and an apparent gas velocity is 1-20 m/s, wherein the agent-oil ratio is a mass ratio between an amount of the bed material fed and an amount of the heavy oil feedstock fed.

5. The integrated method according to claim 1, wherein, a reaction temperature of the gasification reaction is 850-1200□, a reaction pressure is atmospheric pressure, an apparent gas velocity is 0.1-5.0 m/s, and a residence time is 1-20 min.

6. The integrated method according to claim 2, wherein, before the coke is carried by the bed material downward into the gasification section in a lower portion of the cracking-gasification coupled reactor, further comprising performing a steam stripping processing and a particle size refining processing sequentially to the downward bed material particles.

7. The integrated method according to claim 3, wherein, before the coke is carried by the bed material downward into the gasification section in a lower portion of the cracking-gasification coupled reactor, further comprising performing a steam stripping processing and a particle size refining processing sequentially to the downward bed material particles.

8. The integrated method according to claim 4, wherein, before the coke is carried by the bed material downward into the gasification section in a lower portion of the cracking-gasification coupled reactor, further comprising performing a steam stripping processing and a particle size refining processing sequentially to the downward bed material particles.

9. The integrated method according to claim 5, wherein, before the coke is carried by the bed material downward into the gasification section in a lower portion of the cracking-gasification coupled reactor, further comprising performing a steam stripping processing and a particle size refining processing sequentially to the downward bed material particles.

10. The integrated method according to claim 1, wherein, conditions of the steam stripping processing are: a mass ratio of water vapor to the heavy oil feedstock is 0.1-0.3, a temperature of the water vapor is 200-400° C., and an apparent gas velocity of the water vapor is 0.5-5.0 m/s.

11. The integrated method according to claim 1, wherein Conradson carbon residue of the heavy oil feedstock is larger than or equal to 8%.

12. The integrated method according to claim 2, wherein Conradson carbon residue of the heavy oil feedstock is larger than or equal to 8%.

13. The integrated method according to claim 3, wherein Conradson carbon residue of the heavy oil feedstock is larger than or equal to 8%.

14. The integrated method according to claim 4, wherein Conradson carbon residue of the heavy oil feedstock is larger than or equal to 8%.

15. The integrated method according to claim 5, wherein Conradson carbon residue of the heavy oil feedstock is larger than or equal to 8%.

16. The integrated method according to claim 10, wherein Conradson carbon residue of the heavy oil feedstock is larger than or equal to 8%.

17. An integrated apparatus for catalytic cracking of heavy oil and production of syngas configured to implement the integrated method according to claim 1, comprising:

a cracking-gasification coupled reactor, comprising a cracking section and a gasification section that are internally connected with each other, and an oil-gas outlet located on top of the cracking-gasification coupled reactor and connected with the cracking section;

the cracking section is located above the gasification section;

the cracking section is provided with a feedstock inlet and a first solid phase inlet;

the gasification section is provided with a second solid phase inlet;

a gas-solid separation system, comprising: a material inlet, a gas phase outlet and a solid phase outlet;

a first gas-solid separator and a second gas-solid separator, the first gas-solid separator comprises a first material inlet, a first gas phase cutlet and a first solid phase outlet, and the second gas-solid separator comprises a second material inlet, a second gas phase outlet and a second solid phase outlet;

and a fractionating tower, comprising: a fractionating tower inlet and multiple light component outlets;

wherein the oil-gas outlet of the cracking-gasification coupled reactor is connected with the first material inlet, the first gas phase outlet is connected with the second material inlet, and the second gas phase outlet is connected with the fractionating tower inlet;

the first solid phase outlet is connected with the first solid phase inlet of the cracking section;

the second solid phase outlet is connected with the second solid phase inlet of the gasification section;

wherein the gas-solid separation system is located outside the cracking-gasification coupled reactor.

* * * * *